US012779522B2

(12) United States Patent
Bi et al.

(10) Patent No.: US 12,779,522 B2
(45) Date of Patent: Nov. 3, 2026

(54) METHOD FOR FORMING ZINC-PLATED STEEL PLATE OR STEEL BELT HAVING GOOD CORROSION RESISTANCE

(71) Applicant: BAOSHAN IRON & STEEL CO., LTD., Shanghai (CN)

(72) Inventors: Wenzhen Bi, Shanghai (CN); Jiyao Hong, Shanghai (CN); Li Wang, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 766 days.

(21) Appl. No.: 17/298,292

(22) PCT Filed: Nov. 29, 2019

(86) PCT No.: PCT/CN2019/121859

§ 371 (c)(1),
(2) Date: May 28, 2021

(87) PCT Pub. No.: WO2020/108593

PCT Pub. Date: Jun. 4, 2020

(65) Prior Publication Data

US 2022/0023929 A1 Jan. 27, 2022

(30) Foreign Application Priority Data

Nov. 30, 2018 (CN) ..... 201811453322.6

(51) Int. Cl.

| | |
|---|---|
| ***B21D 22/02*** | (2006.01) |
| ***C21D 8/02*** | (2006.01) |
| ***C21D 8/0221*** | (2026.01) |
| ***C22C 38/00*** | (2006.01) |
| ***C22C 38/02*** | (2006.01) |
| ***C22C 38/06*** | (2006.01) |
| ***C22C 38/22*** | (2006.01) |
| ***C22C 38/26*** | (2006.01) |
| ***C22C 38/28*** | (2006.01) |
| ***C22C 38/32*** | (2006.01) |

(52) U.S. Cl.

CPC ..... *B21D 22/022* (2013.01); *C21D 8/02* (2013.01); *C21D 8/0221* (2013.01); *C22C 38/001* (2013.01); *C22C 38/002* (2013.01); *C22C 38/005* (2013.01); *C22C 38/02* (2013.01); *C22C 38/06* (2013.01); *C22C 38/22* (2013.01); *C22C 38/26* (2013.01); *C22C 38/28* (2013.01); *C22C 38/32* (2013.01)

(58) Field of Classification Search

CPC ..... C21D 8/0205

See application file for complete search history.

(56) References Cited

U.S. PATENT DOCUMENTS

| | | | | |
|---|---|---|---|---|
| 2011/0017362 | A1* | 1/2011 | Warnecke | C21D 9/46 148/320 |
| 2016/0122845 | A1* | 5/2016 | Akiba | C21D 8/0226 148/330 |
| 2018/0281348 | A1* | 10/2018 | Otomo | C22C 38/001 |
| 2021/0115527 | A1* | 4/2021 | Chen | C22C 38/22 |

FOREIGN PATENT DOCUMENTS

| | | | | |
|---|---|---|---|---|
| CN | 1600877 | A | 3/2005 | |
| CN | 101849029 | A | 9/2010 | |
| CN | 104846274 | A | 8/2015 | |
| CN | 106756697 | A | 5/2017 | |
| CN | 107127238 | A | 9/2017 | |
| CN | 109365606 | A | 2/2019 | |
| JP | 2009228134 | A | 10/2009 | |
| JP | 2013227614 | A | 11/2013 | |
| WO | WO-2008102009 | A1 * | 8/2008 | B32B 15/013 |

OTHER PUBLICATIONS

International Search Report mailed on Feb. 24, 2020 for PCT Patent Application No. PCT/CN2019/121859.

Written Opinion mailed on Feb. 24, 2020 for PCT Patent Application No. PCT/CN2019/121859.

* cited by examiner

*Primary Examiner* — Christopher S Kessler

(74) *Attorney, Agent, or Firm* — Lei Fang, Esq.; Smith Tempel Blaha LLC

(57) ABSTRACT

A method for forming a zinc-plated steel plate or steel belt having good corrosion resistance, comprising the following steps: 1) conveying the steel plate or steel belt into a heating furnace higher than $Ac_3$, austenitizing the steel plate or steel belt, and keeping the temperature for 1-7 minutes; 2) before the steel plate or steel belt leaves the heating furnace and enters a forming mold, applying different cooling manners according to different plated thicknesses, wherein when the single-sided weight of the plating is less than or equal to 50 $g/m^2$, only air cooling is required before transferring to the forming mold, when the single-sided weight of the plating is greater than 50 $g/m^2$, aerial fog or water mist precooling is performed before transferring to the forming mold, and the steel plate is cooled to be below 700° C. at a cooling sped greater than 30° C./s; and 3) rapidly transferring the steel plate or steel belt to the mold for hot stamping forming, wherein a transferring duration does not exceed 1 minute, and the temperature of the hot stamping forming is controlled between 400-800° C. The tensile strength of the steel plate or steel belt after hot stamping is greater than 1,450 MPa, and substrate cracks caused by local press and LME in an element are avoided.

4 Claims, 1 Drawing Sheet

METHOD FOR FORMING ZINC-PLATED STEEL PLATE OR STEEL BELT HAVING GOOD CORROSION RESISTANCE

CROSS-REFERENCE TO RELATED APPLICATIONS

This application is a 371 U.S. National Phase of PCT International Application No. PCT/CN2019/121859 filed on Nov. 29, 2019, which claims benefit and priority to Chinese patent application no. CN 201811453322.6 filed on Nov. 30, 2018, the contents of both are incorporated by reference herein in their entireties.

TECHNICAL FIELD OF THE INVENTION

The present disclosure relates to automobile steel, in particular to a method for forming a zinc-based plated steel plate or steel belt having good corrosion resistance. The steel plate or steel belt is mainly used for manufacture of automobile B-pillars, door anti-collision beams, bumpers and other structural parts.

BACKGROUND OF THE INVENTION

"Lightweight" of automobiles can directly reduce emissions and reduce fuel consumption, which is a goal of development in today's automobile manufacturing industry. The application of high-strength steel and ultra-high-strength steel has become one of the mainstream development trends in the automobile manufacturing field. However, due to the fact that ultra-high-strength steel plates are prone to poor shape, high processing and forming loads, and large resilience values during cold working, the use of the ultra-high-strength steel plates is affected. Hence, hot stamping forming is an important way to provide ultra-high-strength steel parts.

There are mainly two existing hot stamping forming processes, namely direct hot stamping and indirect hot stamping. In the direct hot stamping process, a steel plate is heated to a temperature higher than the austenitizing temperature and kept for a certain period of time so that the steel plate is completely austenitized. Then, the heated steel plate is transferred to a forming mold and formed therein into a finished element in a one-step forming process, and at the same time, quenching hardening is achieved by means of cooling by the mold (the cooling rate of the mold is greater than the critical cooling rate of the steel plate).

In the indirect hot stamping process, a multi-step forming process is first used to form the element almost to a full extent (generally 90% pre-forming). Then, the nearly formed element is placed in a heating furnace to be heated to complete full austenization, and kept for a period of time. After that, the heated element is transferred to a forming mold corresponding to the final size of the element. Special attention should be paid to the thermal expansion of the pre-formed element. After the specific cooling of the mold is completed, the pre-formed element is cooled in the mold at a cooling rate greater than the critical cooling rate to achieve hardening.

Traditional non-plated hot stamping parts will cause decarburization and oxidative scaling of the surface of a stamped steel plate during heating. In order to avoid oxidation and decarburization of the surface of the hot stamped steel plate so that the hot stamped steel plate has high temperature resistance and corrosion resistance, a plating technology suitable for hot stamped steel has been developed. At present, hot stamping coatings mainly include aluminum-silicon (Al-10Si) coatings, hot-dip pure zinc (GI) coatings, alloyed zinc iron (GA) coatings and galvanized zinc-nickel (Zn-10Ni) coatings.

In the direct hot stamping process, a zinc-based plated steel for hot stamping protected against cathodic corrosion can be provided. Due to the effect of LME, micro-cracks (10 um to 100 um), even macro-cracks that can extend across the entire plate thickness, may be generated in the steel substrate. Hence, the application and development of zinc-based plated steel plates for hot stamping is hindered. The use of indirect hot stamping process can reduce the number of cracks in the substrate in the subsequent hardening process after forming, but cracks cannot be avoided either. At the same time, the production cost of parts is increased. Because of this, there is so far no zinc-based plated steel for hot stamping is put into application in Asia. Instead, the use of aluminum/silicon coatings is preferred. However, the aluminum/silicon coatings cannot provide protection against cathodic corrosion. In order to further improve the corrosion resistance of the coatings, the development of galvanizing materials has also turned from pure zinc to zinc alloys. Since the publication of Inland Steel's three patent applications: GB1125965A, U.S. Pat. Nos. 3,505,043A and 3,505,042A in which appropriate amounts of Al and Mg are added to Zn to further provide good corrosion resistance, people have been conducting various development and research on the family of Zn—Al—Mg plated steel plates. The main work is to incorporate various other additive elements, or limit the production process parameters to further improve the corrosion resistance or facilitate manufacturing and reduce production costs.

SUMMARY OF THE INVENTION

One object of the present disclosure is to provide a method for forming a zinc-based plated steel plate or steel belt having good corrosion resistance. The tensile strength of the zinc-based plated steel plate or steel belt after hot stamping is greater than 1450 MPa, preferably greater than or equal to 1500 MPa, while substrate cracks caused by local stress and LME in an element is avoided. It is suitable for manufacturing automobile B-pillars, door anti-collision beams, bumpers and other structural parts.

To achieve the above object, the technical solution of the present disclosure is as follows:

A method for forming a zinc-based plated steel plate or steel belt having good corrosion resistance, comprising the following steps:

1) Delivering a zinc-based plated steel plate or steel belt to a heating furnace to completely austenitize the zinc-based plated steel plate or steel belt at a temperature that is higher than $Ac_3$, preferably less than 1000° C., and held for 1 to 7 minutes; wherein the zinc-based plated steel plate or steel belt comprises a substrate and a zinc-based coating on at least one surface thereof;
2) Cooling the zinc-based plated steel plate or steel belt after it exits the heating furnace but before it enters a forming mold in a cooling process selected from the following cooling processes depending on coating thickness:

For a thin-coating steel plate or steel belt having a one-side coating weight ≤50 g/m$^2$, cooling it only in air, preferably to 800° C. or less, before it is transferred to the forming mold;

For a thick-coating steel plate or steel belt having a one-side coating weight >50 g/m$^2$, pre-cooling it with gas spray or water spray, and cooling the steel plate or steel belt to 700° C. or less at a cooling rate of greater than 30° C./s, such as 40-80° C./s, before it is transferred to the forming mold;

3) After the cooling, transferring the zinc-based plated steel plate or steel belt to the forming mold for hot stamping forming in a period of time of no more than 1 minute, wherein the hot stamping forming is performed at a temperature controlled at 400-800° C.

Preferably, the substrate of the zinc-based plated steel plate or steel belt has a composition based on mass of: C: 0.1-0.8%, Si: 0.05-2.0%, Mn: 0.5-3.0%, P: 0.1% or less, S: 0.05% or less, Al: 0.1% or less, N: 0.01% or less, and a balance of Fe and unavoidable impurities.

Preferably, the composition of the substrate of the zinc-based plated steel plate or steel belt further comprises, based on mass, at least one of Cr: 0.01-1.0%, Mo: 0.01-1.0%, Ti: 0.2% or less, Nb: 0.01-0.08%, and V: 0.01-1.0%, B: 0.001-0.08%. In some embodiments, the composition of the substrate of the zinc-based plated steel plate or steel belt further comprises, based on mass, 0.05-0.2% Cu and 0.05-0.2% Ni.

In some embodiments, the zinc-based plated steel plate or steel belt is an ultra-high-strength steel 22MnB5, and its elemental composition based on mass is as follows: C, 0.22-0.25%; Mn, 1.2-1.4%; Si, 0.2-0.3%; P≤0.02%; S≤0.01%; B, 0.002-0.0035%; Al, 0.02-0.05%; Ti, 0.02-0.05%; Cr, 0.11-0.20%; Mo, 0.05-0.2%; Cu, 0.05-0.2%; and Ni, 0.05-0.2%.

Preferably, the zinc-based coating has a chemical composition based on mass of Al 0.15%-6.5%, Mg 0.2-7%, RE<0.2%, Sr 0.002-0.2%, and a balance of Zn and unavoidable impurities, wherein Mg/Al in the chemical composition of the coating is greater than 1.0.

Preferably, the zinc-based coating further comprises at least one or two of Mn and Cr, the total amount of which is greater than 0.1%, preferably less than 5%.

In the compositional design of the zinc-based coating according to the present disclosure:

(1) When the aluminum content is less than 0.15%, the effect of improving the corrosion resistance of the coating is not significant, and when the aluminum content is higher than 6.5%, the welding performance is poor.

(2) When the Mg content is less than 0.2%, the effect of improving the corrosion resistance is not significant, and when the Mg content is higher than 7%, the surface of the plating solution is seriously oxidized and the surface quality of the product is poor.

(3) When Al/Mg is greater than 1, under the same Al content, the content of the Mg element is limited, and the effect of Mg element on the corrosion resistance of the coating is hindered. Simply increasing the Mg element will make the surface oxidation of the plating solution very serious. In the present disclosure, the surface oxidation of the plating solution is suppressed by adding Sr and a rare earth element(s), so the content of the Mg element in the plating solution can be increased under the same Al content. Not only the degree of the surface oxidation is controlled, but also the effect of the Mg element in improving the corrosion resistance of the coating is achieved.

Based on the research of the present disclosure, it is found that the contact between molten zinc and austenite must be minimized during the forming stage. This contact can be minimized by reducing the temperature at which the stamping in the mold starts (i.e., the forming start temperature). By minimizing the contact between molten zinc and austenite, substrate cracks caused by LME during the hot stamping can be avoided.

In the embodiments of the present disclosure, the thickness of the coating determines the cooling process applied to the steel plate after it is heated and held but before it is transferred to the mold. A thin-coating steel plate or steel belt (≤50 g/m$^2$ at one side) only needs air cooling. That is, the cooling rate is not more than 20° C./s, and it is cooled to 650-800° C., preferably 650-750° C. to start the forming. A thick-coating steel plate or steel belts (>50 g/m$^2$ at one side) needs additional cooling, such as gas spray cooling or water spray cooling, for the purpose of hot stamping the steel plate at a temperature lower than the melting point of the zinc coating. The forming temperature of the thick-coating steel plate or steel belt is in the range of lower than 780° C., preferably 400-650° C., more preferably 450-650° C. in the present disclosure.

The pressure holding time of the hot stamping forming of the present disclosure is 3-15 seconds, and the stamping force is 300-1000 tons. After the hot stamping forming is completed, the steel plate or steel belt is cooled in the mold to 200° C. or less, such as 150-190° C., and then cooled to room temperature after it is removed from the mold to complete the martensitic transformation.

Compared with the prior art, the performances of the hot stamped parts obtained according to the present disclosure are substantially comparable with those of the traditional hot stamped parts (having a tensile strength of greater than 1450 MPa), but the present disclosure can improve the corrosion resistance of the steel plate. Moreover, the present process can avoid substrate cracks caused by LME after hot stamping.

BRIEFLY DESCRIPTION OF THE DRAWINGS

DETAILED DESCRIPTION OF THE INVENTION

The present disclosure will be further illustrated with reference to the following Examples and accompanying drawings.

See Table 1 for the embodiments of the present disclosure. The substrates of the zinc-based plated steel plates of the Examples and Comparative Examples are all ultra-high-strength steel 22MnB5, and the coatings contain Al, Mg, Sr, Zn and unavoidable impurities, wherein the Al content ranges from 0.15% to 6.5%, the Mg content ranges from 0.2% to 7%, the Sr content ranges from 0.002% to 0.2%, the balance is Zn and unavoidable impurities, and Mg/Al is greater than 1.0.

From the results of the Examples and Comparative Examples in Table 1, it can be seen that when the coating is thin, as in Examples 1 to 3, normal air cooling before hardening in the mold does not lead to generation of microcracks. As the coating thickness increases, under higher heating temperature and longer temperature holding time, an additional pre-cooling process can help to control the generation of microcracks, as in Examples 6 and 10. Therefore, as the coating thickness increases, in order to obtain qualified parts without microcracks, it is necessary to: 1) increase the soaking temperature in the heating furnace; 2) increase the temperature holding time for austenization in the heating furnace; and 3) add a pre-cooling process.

According to the method of the present disclosure, different cooling processes are utilized for different coating thicknesses before the steel plates or belts enter the mold for forming.

Figure 2:
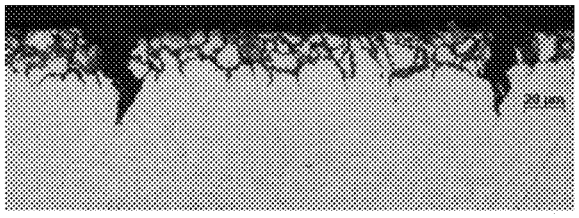
FIG. 2 is a cross-sectional metallography (with cracks) of the Comparative Example.

Macroscopic liquid metal embrittlement (LME) cracks or microcracks are always generated in zinc-based plated hot stamped steel obtained by conventional hot stamping (see FIG. 2).

Figure 1:
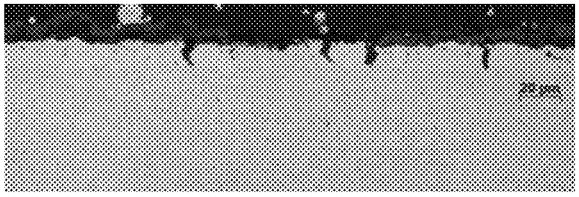
FIG. 1 is a cross-sectional metallography (free of microcracks) of a zinc-based plated hot-formed steel plate in Example 3 according to the present disclosure.

The hot stamping process of the present disclosure can avoid generation of cracks in the substrate of the zinc-based plated hot stamped steel plate during stamping forming (see FIG. 1), and the steel plate has better corrosion resistance. This process is of great significance to the development of zinc-based plated steel for hot stamping.

TABLE 1

Hot Stamping Forming Process and Evaluation

| Test No. | Coating Thickness ($g/m^2$) | Heating Process: Heating Temperature (° C.) | Heating Process: Holding Time (min) | Heating Process: Cooling Process | Forming Conditions: Average Cooling Rate Before Forming (° C./s) | Forming Conditions: Forming Start Temperature (° C.) | Forming Conditions: Cooling End Temperature (° C.) | Zn Content in Coating After Forming (wt %) | Evaluation: Formality | Evaluation: Micro-cracks | Evaluation: Tensile Strength |
|---|---|---|---|---|---|---|---|---|---|---|---|
| Ex. 1 | 35 | 850 | 4 | Air | about 8 | 664 | 178 | 32 | ○ | ○ | 1477 |
| Ex. 2 | 35 | 880 | 3 | Air | about 8 | 682 | 185 | 30 | ○ | ○ | 1499 |
| Ex. 3 | 35 | 900 | 2 | Air | about 8 | 685 | 183 | 25 | ○ | ○ | 1512 |
| Comp. Ex. 4 | 60 | 880 | 4 | Air | about 8 | 785 | 185 | 35 | ○ | x | 1495 |
| Comp. Ex. 5 | 60 | 880 | 4 | Water Spray | about 50 | 582 | 156 | 35 | ○ | x | 1509 |
| Comp. Ex. 6 | 60 | 930 | 4 | Water Spray | about 50 | 612 | 167 | 30 | ○ | ○ | 1521 |
| Comp. Ex. 7 | 105 | 880 | 4 | Air | about 8 | 796 | 185 | 41 | ○ | x | 1483 |
| Comp. Ex. 8 | 105 | 880 | 4 | Water Spray | about 50 | 778 | 156 | 43 | ○ | x | 1489 |
| Comp. Ex. 9 | 105 | 930 | 4 | Water Spray | about 50 | 810 | 167 | 37 | ○ | x | 1502 |
| Ex. 10 | 105 | 930 | 6 | Water Spray | about 50 | 521 | 165 | 33 | ○ | ○ | 1514 |

What is claimed is:

1. A method for forming a zinc-based plated steel plate or steel belt having good corrosion resistance, comprising the following steps:

1) Delivering a zinc-based plated steel plate or steel belt to a heating furnace to completely austenitize the zinc-based plated steel plate or steel belt at a temperature that is ≥900° C. and held for 1 to 7 minutes; wherein the zinc-based plated steel plate or steel belt comprises a substrate and a zinc-based coating on at least one surface thereof; wherein a one-side coating weight of the zinc-based coating is >50 $g/m^2$;

2) A Cooling the zinc-based plated steel plate or steel belt after it exits the heating furnace but before it enters a forming mold: pre-cooling the steel plate or steel belt with gas spray or water spray, and cooling the steel plate or steel belt to 400-650° C. at a cooling rate of greater than 30° C./s before it is transferred to the forming mold;

3) After the cooling, transferring the zinc-based plated steel plate or steel belt to the forming mold for hot stamping forming in a period of time of no more than 1 minute, wherein the hot stamping forming is performed at a temperature controlled at 400-800° C.;

wherein the substrate of the zinc-based plated steel plate or steel belt is an ultra-high-strength steel 22MnB5, and its elemental composition based on mass is as follows: C, 0.22-0.25%; Mn, 1.2-1.4%; Si, 0.2-0.3%; P≤0.02%; S≤0.01%; B, 0.002-0.0035%; Al, 0.02-0.05%; Ti, 0.02-0.05%; Cr, 0.11-0.20%; Mo, 0.05-0.2%; Cu, 0.05-0.2%; and Ni, 0.05-0.2%;

wherein the zinc-based coating has a chemical composition based on mass of Al 0.15%-6.5%, Mg 0.2-7%, RE<0.2%, Sr 0.002-0.2%, and a balance of Zn and unavoidable impurities, wherein Mg/Al in the chemical composition of the coating is greater than 1.0; and wherein the method avoids generation of cracks in a substrate of a zinc-based plated hot stamped steel plate during hot stamping forming.

2. The method for forming a zinc-based plated steel plate or steel belt having good corrosion resistance according to claim 1, wherein the zinc-based coating further comprises at least one or two of Mn and Cr, the total amount of which is greater than 0.1% and less than 5%.

3. The method for forming a zinc-based plated steel plate or steel belt having good corrosion resistance according to claim 1, wherein a pressure holding time of the hot stamping forming is 3-15 seconds, and a stamping force is 300-1000 tons.

4. The method for forming a zinc-based plated steel plate or steel belt having good corrosion resistance according to claim 1, wherein the method further comprises cooling the steel plate or steel belt in the mold to 200° C. or less after the hot stamping forming is completed, removing it from the mold, and then cooling it to room temperature.

* * * * *